United States Patent [19]

Bower et al.

[11] Patent Number: 5,032,823

[45] Date of Patent: Jul. 16, 1991

[54] SECURE PERSONNEL MONITORING SYSTEM

[75] Inventors: David S. Bower, Deerfield Beach; Ronald C. Davies, Ft. Lauderdale; Donald E. Garee, Wilton Manors, all of Fla.

[73] Assignee: Digital Products Corporation, Fort Lauderdale, Fla.

[21] Appl. No.: 566,307

[22] Filed: Aug. 10, 1990

Related U.S. Application Data

[63] Continuation of Ser. No. 200,088, May 27, 1988, abandoned.

[51] Int. Cl.[5] ..... G08B 13/14

[52] U.S. Cl. ..... 340/568; 340/572; 340/573; 340/590; 340/596; 340/539; 340/531

[58] Field of Search ..... 340/568, 572, 573, 533, 340/539, 531, 590, 596, 665, 666, 647, 652, 595, 598, 825.49, 825.54; 379/38, 40, 41, 51

[56] References Cited

U.S. PATENT DOCUMENTS

| | | | |
|---|---|---|---|
| 2,691,698 | 10/1954 | Schmidt | 340/647 |
| 3,806,874 | 4/1974 | Ehrat . | |
| 3,824,540 | 7/1974 | Smith, II | 340/427 |
| 4,136,338 | 1/1979 | Antenore | 340/573 |
| 4,510,495 | 4/1985 | Sigrimis et al. | 340/825.54 |
| 4,682,155 | 7/1987 | Shirley | 340/572 |
| 4,694,284 | 9/1987 | Leveille et al. | 340/573 |
| 4,736,196 | 4/1988 | McMahon et al. | 340/573 |
| 4,751,500 | 6/1988 | Minasy et al. | 340/572 |
| 4,777,478 | 10/1988 | Hirsch et al. | 340/539 |
| 4,792,796 | 12/1988 | Bradshaw et al. | 340/573 |
| 4,853,692 | 9/1989 | Wolk et al. | 340/572 |
| 4,885,571 | 12/1989 | Pauley et al. . | |

FOREIGN PATENT DOCUMENTS

| | | |
|---|---|---|
| 017448 | 10/1980 | European Pat. Off. . |
| 107059 | 5/1984 | European Pat. Off. . |
| 125930 | 11/1984 | European Pat. Off. . |
| 3023427 | 1/1981 | Fed. Rep. of Germany . |
| WO85/01582 | 4/1983 | PCT Int'l Appl. . |

*Primary Examiner*—Donnie L. Crosland

*Attorney, Agent, or Firm*—Lerner, David, Littenberg, Krumholz & Mentlik

[57] ABSTRACT

A personnel monitoring system includes a tag worn by each monitored person. The tag repeatedly emits digital radio signals, and a predetermined bit in the signal changes with time according to a predetermined pattern. Monitoring apparatus detects the radio signals and sends an absence alarm signal if the signals cease. The monitoring apparatus detects spurious, forged signals which do not replicate the predetermined pattern of variation and provides a forgery alarm signal. The tag may be attached to the person by a strap bearing parallel electrical conductors. Attempts to remove the tag by servering the strap cause electrical contact between the conductors. Such contact triggers a detector, which in turn alters the ratio signal.

22 Claims, 7 Drawing Sheets

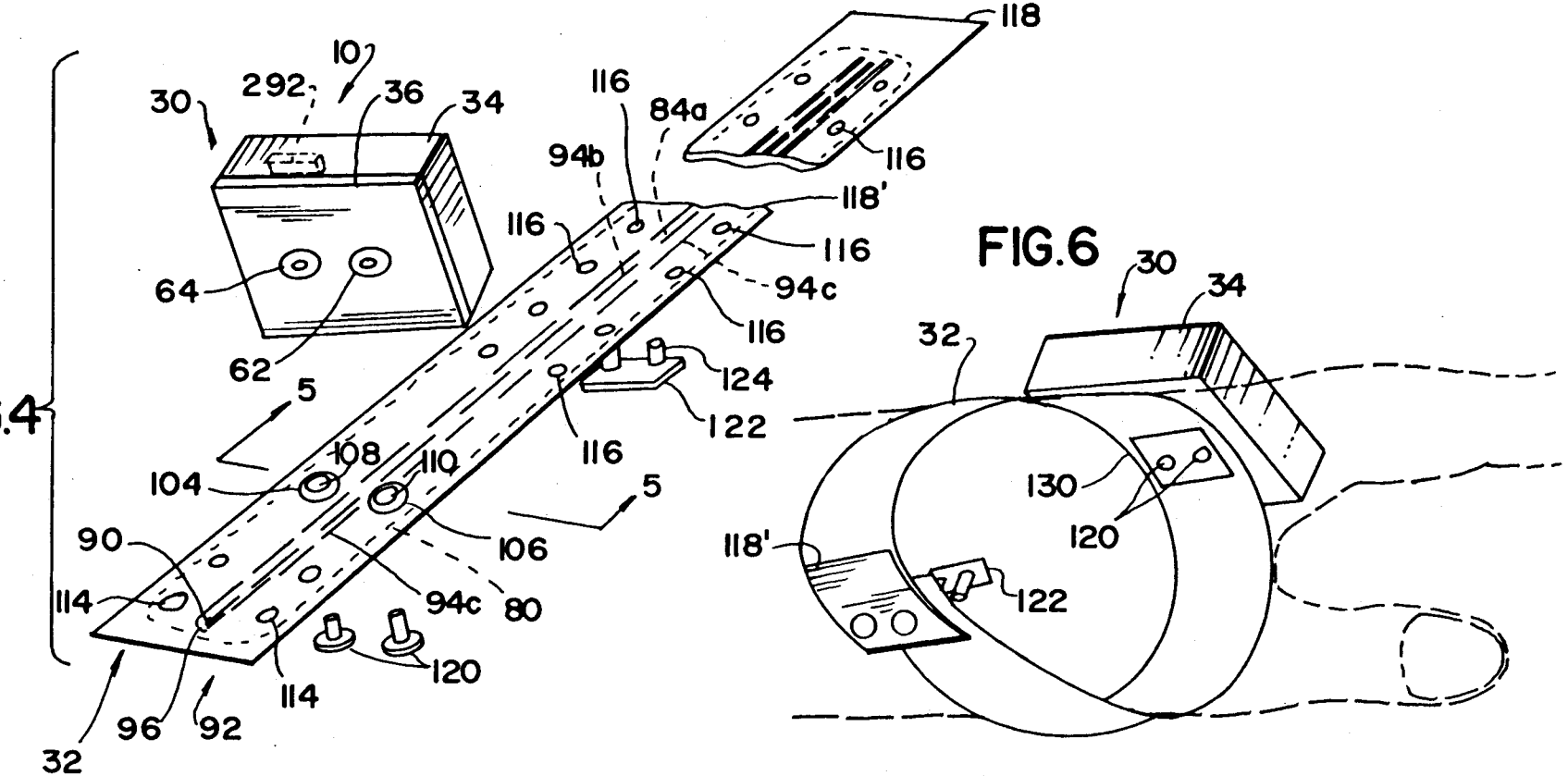
FIG.4
FIG.6
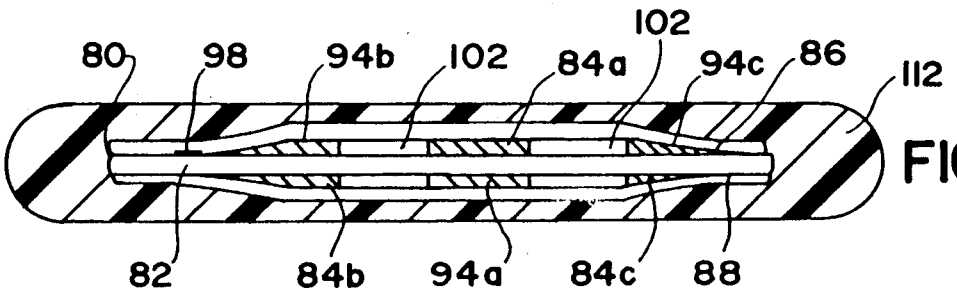
FIG.5

SECURE PERSONNEL MONITORING SYSTEM

This is a continuation of application Ser. No. 200,088, filed May 27, 1988, now abandoned.

BACKGROUND OF THE INVENTION

The present invention pertains to security systems such as personnel monitoring systems and also pertains to components and methods useful in connection with such systems.

Automated systems have been developed for monitoring persons placed under house arrest. Such automated systems are intended to verify the presence of the monitored individual at his home or at another specified location. With such a system, a person can be sentenced to house arrest either continuously or during specified hours of the day as a punishment for crime. Such a sentence may be employed either as an alternative to incarceration in a conventional jail or as an alternative to an ordinary parole program. House arrest is widely regarded as a desirable alternative to conventional incarceration for offenders other than the most hardened, dangerous criminals. House arrest avoids the costs associated with conventional jails and also avoids the adverse effects on the inmate of exposure to other criminals while in jail. Additionally, a person sentenced to house arrest can maintain his contacts with his family and neighborhood and may also maintain his employment, thus facilitating his re-integration into society. House arrest with automated monitoring is also regarded as a useful alternative to conventional parole programs. An automatic monitoring system can provide substantially continuous monitoring of the offender's behavior which cannot be provided by any practical program of personal visits by parole officers.

Many of the automated monitoring systems employed heretofore use a computer installed at a central station in conjunction with devices at monitoring locations remote from the central station, such as in the individual parolee's home. Each parolee may wear a tag permanently secured to his body such as a wristlet or anklet. Each tag bears unique encoded information. Each remote device is arranged to respond to the tag of the appropriate parolee and to verify to the central computer that the tag, and hence the parolee is present at the remote location. A system described in copending, commonly assigned U.S. Pat. application No. 765,343 filed Aug. 13, 1985, now U.S. Pat. No. 4,747,120 employs passive encoded tags attached to each parolee. The central computer periodically places telephone calls to the home of each parolee and signals the parolee to insert the tag into a tag verifying device at his home. If the correct tag is inserted into the tag verifying device in response to the signal sent by the central computer, the device sends an appropriate return signal to the central computer. If the central computer does not receive such a return signal in response to its call, the central computer can generate an appropriate alarm signal indicating that the parolee is not present. Other parolee monitoring systems employ a small, low-powered radio frequency or "RF" transmitter in each tag. Each such transmitter is arranged to send an RF signal bearing a unique identifying code. The remote monitoring device at each parolee's home incorporates an RF receiver and means for detecting receipt of the appropriate encoded RF signal. If the remote monitoring device does not receive the appropriate monitoring signal, it automatically places a telephone call to the central computer and sends a message to the central computer indicating that the parolee is absent.

These systems require that the tag remain attached to the parolee so that presence of the tag at the remote location necessarily will indicate that the parolee is present. Systems employing passive tags typically utilize a "tamper evident" securement strap, such that the tag cannot be removed without permanently deforming or damaging some physical element of the tag. Periodic inspections of the tag by a parole officer suffice to insure that the tag has been secured to the parolee at all times between such inspections. Systems using RF transmitting tags typically provide a sensor in the tag itself to alter operation of the transmitter if the tag is removed from the body of the parolee, so that the remote monitoring device will call the central computer and report a violation if the parolee removes the tag from his body. Ordinarily, the tag is attached to the parolee's body by a strap connected to the transmitter housing and having its ends connected to form a closed loop encircling the parolee's wrist or ankle. The strap includes a conductive element, and an electronic sensing circuit continually passes a current through the conductive element of the strap. This circuit is arranged to detect any cessation of the current flow and thus detect any breakage or disconnection of the strap. In this event, the circuit switches the transmitter to a tamper mode, wherein the transmitter does not send the normal signal. An electronic latch circuit is provided to keep the transmitter in tamper mode after even a momentary interruption of the current flow through the conductor in the strap, so that the system cannot be defeated by cutting the strap and then reconnecting it. Systems of this type supposedly provide better security than provided by a tamper evident securement with periodic visual inspection.

Unfortunately, systems of this type have been unreliable and susceptible to cheating. The sensing circuit must be powered by a self-contained power source such as a small storage battery. To provide acceptable battery life, the sensing circuit must operate with a very small current flow through the conductor in the strap. Such low current, high impedance circuits typically are susceptible to interference from stray electromagnetic fields and hence may provide a false indication of tampering. Moreover, the sensing circuit typically places the transmitter in tamper mode while the tag is being attached to the parolee by the parole officer. The loop must be open so that the parole officer can place the tag on the parolee's wrist or ankle. Therefore, a reset device must be built into the transmitter. After securing the tag on the parolee, the parole officer activates the reset device, thus overriding the latch circuit and restoring the transmitter to normal mode. Such reset devices severely compromise the security of the system. The parolee necessarily must be present during resetting and hence can observe the resetting procedure. The parolee often can make an educated guess as to the mechanism used to reset the transmitter. He can then actuate the reset device himself and defeat the system.

Moreover, RF systems utilized heretofore can be defeated by counterfeiting the RF signals. RF tag systems utilized heretofore ordinarily employ standardized radio transmitters such as those employed with radio actuated garage door openers, home security systems and the like. Although it would be theoretically possible to develop entirely unique transmitters and receivers for personnel monitoring systems so as to provide a counterfeit-resistant signal with many unique characteristics, the costs of such specialized development and the costs of the required government approval procedures for entirely new transmitter designs render this approach impractical. The security problems posed by use of a standardized transmitter design are aggravated by government labeling requirements. In the United States, any radio transmitter must be labeled with certain required information. This information can be used by an educated criminal to find other commercially available transmitters useful in a counterfeiting effort. The transmitter in the tag typically is arranged to apply a supposedly unique digital code to the transmitted signal. However, there are only a limited number of such codes, and the code used by a particular transmitter can be determined by experimental work. Once the parolee has an appropriately set spurious transmitter, he may violate his parole without detection by the system.

The remote monitoring devices employed in parolee monitoring systems typically share the telephone lines at the parolee's home with the standard telephone instruments. The remote monitoring device typically is provided with features for discriminating between various conditions on the telephone line, including a "off-hook" condition wherein a standard handset connected to the line is in use, and a "on-hook" condition wherein no telephone is in use on the line. It may also be necessary to detect a disconnected condition wherein the line is disconnected from the telephone network. Most telephone systems are arranged so that there is a substantial voltage present when the handset is on-hook, and a lesser voltage present when the handset is off-hook, whereas no voltage is present when the line is disconnected. Accordingly, the discrimination apparatus utilized heretofore has employed voltage sensitive test means operating according to a "voltage window" principle. Thus, a voltage on the line above a first, relatively high threshold indicates an on-hook condition, whereas a voltage below this threshold but above another, lower threshold indicates an off-hook condition and a voltage below the lowest threshold indicates a line disconnected condition. The line condition discrimination apparatus utilized heretofore typically has had very high input impedance so as to limit the current drawn from the telephone line as required by government and telephone company regulations. These systems have been unreliable.

Thus, there have been substantial, unmet needs heretofore for improvement in personnel monitoring systems and in components useful in these and related systems.

SUMMARY OF THE INVENTION

The present invention addresses these needs. One aspect of the present invention provides a personnel monitoring tag of the type wherein an object is secured to the body of a person by fastening means such as a strap and means are provided within the object for transmitting a signal. Indication means having a tamper state and a non-tamper state are provided. The indication means is switchable from the non-tamper state to the tamper state, and includes means for altering the signal emitted when the indicator means is in the tamper state. Latch means are provided for retaining the indication means in the tamper state after the indication means has been switched into the tamper state. Sensor means are provided for detecting detachment of the object from the body of the monitored person and switching the indication means into the tamper state when the object is detached from the body. In a personnel monitoring tag according to this aspect of the invention, the sensor means most preferably is not operative to switch the indication means to the tamper state before the object is first attached to the body of the monitored person. Thus, the indication means is in the non-tamper state when the object is first fastened to the body of the monitored person. Accordingly, there is no need to reset the sensor means back to its non-tamper state after fitting the device on a parolee. This substantially enhances the security of the system, inasmuch as the monitored person does not have the opportunity to learn a reset procedure. Preferably, the indication means and the latch means are arranged without any external reset feature at all. Thus, the indication means and the latch means may be housed within the object attached to the body and arranged so that the indication means cannot be reset from the tamper state to the non-tamper state without opening the object and gaining physical access to the interior components. The object and the components desirably are constructed and arranged so that the object cannot be opened to provide such access without disturbing the signal emitted by the object.

Most preferably, the fastening means employed to attached the object to the body includes an elongated strap. Preferably, means are provided for securing the strap of the body of the parolee so that while the object is secured to the body, the object cannot be disconnected without severing the strap. The sensor means preferably includes means for detecting severance of the strap. The means for detecting severance of the strap may include first and second electrical conductors extending generally lengthwise along the strap in proximity to one another, but normally out of contact with one another, and means for detecting electrical contact between these conductors. An electrically insulating material may be disposed between the first and second conductors, Most preferably, each of the conductors is a metallic conductor, whereas the insulating material disposed between the conductors is a polymeric material such as a plastic resin. The insulating material may be a thin, sheetlike insulator, whereas the conductors may include flat strips disposed on opposite sides of the sheet. This aspect of the present invention incorporates the realization that any attempt to sever the strap will create electrical contact between the conductors, even if the strap is cut with an electrically insulating instrument such as a plastic or glass blade.

Because the severance detection system responds to severance of the strap rather than to loss of continuity in a closed loop, it does not trip the indication means into tamper mode during the initial fitting process, before the strap is secured in a loop around the parolee's body. Preferably, the conductors in the strap are electrically isolated from one another, and the means for detecting electrical contact between the conductors includes means for maintaining the conductors at different potentials and means for detecting a momentary current flow in the conductors. Thus, current flow indicates contact and hence indicates severance of the strap. Under normal conditions, there is no current flow in the conductors. The current flow detection system may be a low-impedance circuit and hence may be substantially immune to interference from stray electromagnetic fields.

Yet another aspect of the invention provides a personnel monitoring system with enhanced security against signal counterfeiting. Preferably, the personnel monitoring system includes transmitter means for automatically sending a transmitter signal having a limited range and bearing a plurality of data bits, each having a discrete value. Fastening means may be provided for attaching the transmitter means to a person to be monitored. Monitoring data may be provided for detecting a signal, recovering data bit values from the signal and testing the recovered bit data bit values to determine whether or not the received signal is a valid signal from the transmitter means. The receiver means may be arranged to issue an indication that the person to be monitored is present in the vicinity of the receiver means only if such a valid signal is received. Most preferably, the transmitter means includes change means for varying the value of at least one predetermined change bit in the transmitted signal according to a predetermined pattern of variation. The receiver means may include change test means for checking the value of each change bit in a received signal and determining whether the checked value varies according to the predetermined pattern of variation. The change test means may be arranged to inhibit issuance of the indication that the person is present by the receiver means if such variation does not occur. The transmitter may be arranged to transmit the signal as a series of bursts at predetermined intervals, and the transmitter change means may be arranged to vary each change bit so that the value of each such change bit fluctuates or "toggles" back and forth between 1 and 0 values on each repetition.

Most preferably, the transmitter change means is arranged to vary the value of less than all of the bits in the transmitted signal with time, and the transmitter means provides predetermined constant values in at least some of the other bits in the transmitted signal. These other bits serve as identifying bits identifying a particular transmitter. Forgery detection means may be provided in the monitoring means. Such forgery detection means may be arranged to issue counterfeit signal indication if the monitoring means receives a signal wherein the identifying bit values correspond to the identifying bit values of a valid signal but wherein the value of each change bit does not vary with time according to the predetermined pattern of variation. Such a counterfeit signal indication can be reported to the central computer as a security violation. Thus, a typical "hacker" or amateur attempt to duplicate the transmitter signal will not only fail to deceive the system but will trigger a violation report. The data bits in the transmitted signal may also include a tamper bit. A predetermined value of the tamper bit indicates an attempt to tamper with the means securing the transmitter means to the monitored person.

Still a further aspect of the present invention provides an apparatus for discriminating between on-hook, off-hook and disconnected conditions on a telephone line. The apparatus preferably includes first test means having a first, relatively high input impedance for monitoring voltage on the telephone line. The first test means preferably is arranged to issue an on-hook signal when the monitored voltage is above a first threshold level and to issue a not-on-hook signal when the voltage is below this level. Second test means may be provided having a second input impedance less than first input impedance for monitoring an electrical condition on the telephone line and for issuing either an off-hook signal or a disconnect signal depending on the monitored electrical condition. Switch means are provided for maintaining the second test means disconnected from the telephone line in response to the on-hook signal. The switch means may be arranged to connect the second test means to the telephone line in response to the not-on-hook signal. Preferably, the second test means includes means such as a resistor for providing the second input impedance and current-sensitive means for issuing the off-hook signal only when the current flow through the second input impedance exceeds a predetermined threshold, and otherwise issuing a disconnect signal. This aspect of the present invention incorporates the realization that it is only necessary to provide a high input impedance in the test apparatus when the line is in an on-hook condition. Because the second test means, used only when the line is not on-hook, has a relatively low input impedance, the second test means can be rendered substantially insensitive to voltage spikes occurring on the telephone line as may be caused by stray electromagnetic interference. The current-sensitive second test means employed in preferred embodiments of the present invention are particularly insensitive to stray electromagnetic interference. Thus, the second test means can discriminate reliably between an off-hook condition and a disconnected condition.

These and other objects, features and advantages of the present invention will be more readily apparent from the detailed description set forth below taken in conjunction with the accompanying drawings.

BRIEF DESCRIPTION OF THE DRAWINGS

FIG. 4 is an exploded view of a personnel monitoring tag utilized in the system of FIGS. 1–3.

FIG. 5 is a schematic sectional view taken along line 5—5 in FIG. 4.

FIG. 6 is a schematic perspective view showing the tag of FIGS. 4 and 5 installed on the body of a person.

DETAILED DESCRIPTION OF A PREFERRED EMBODIMENT

General Organization and Function

Figure 1:
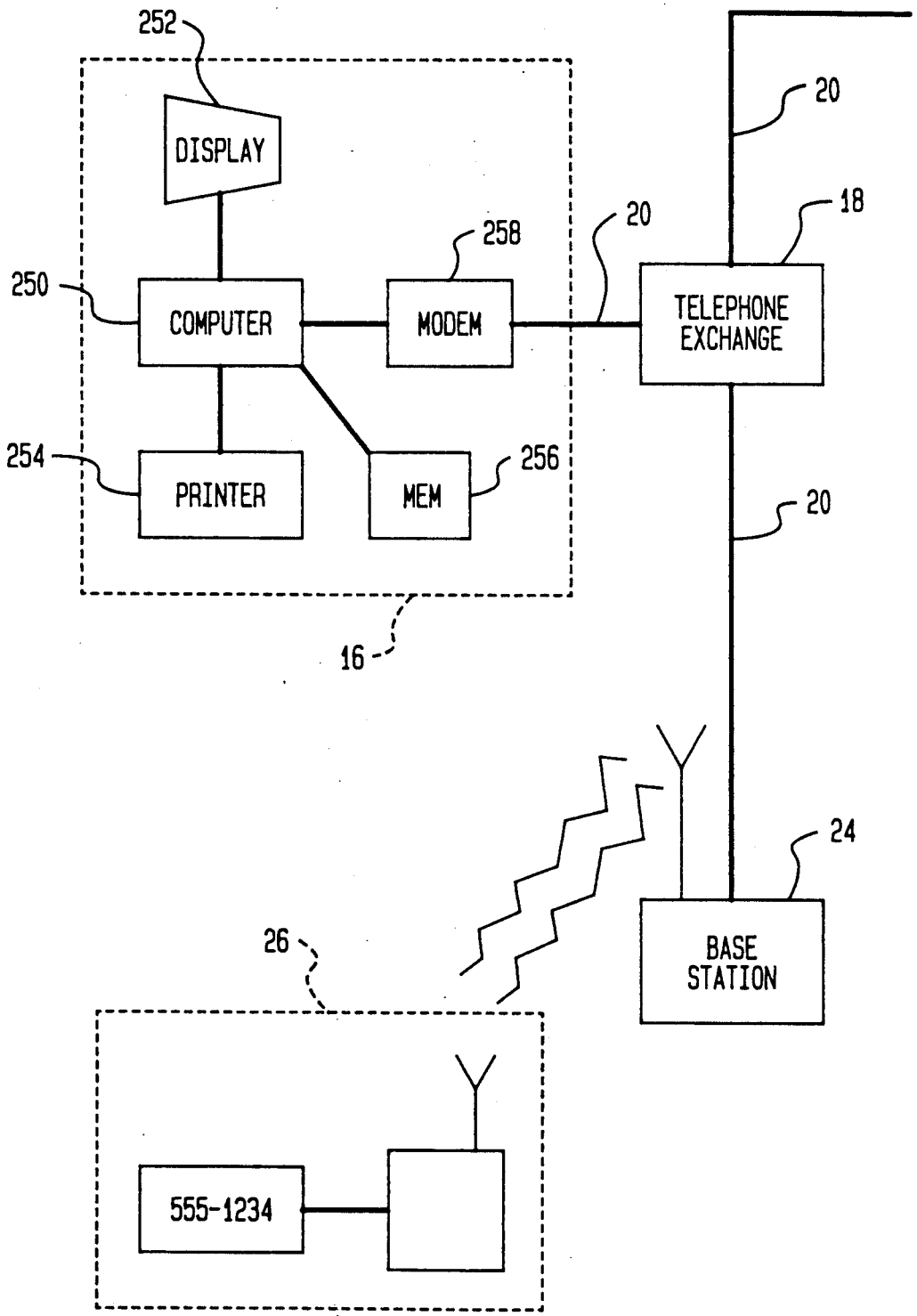
FIGS. 1, 2 and 3 together are a functional block diagram of a personnel monitoring system in accordance with one embodiment of the present invention.
Figure 2:
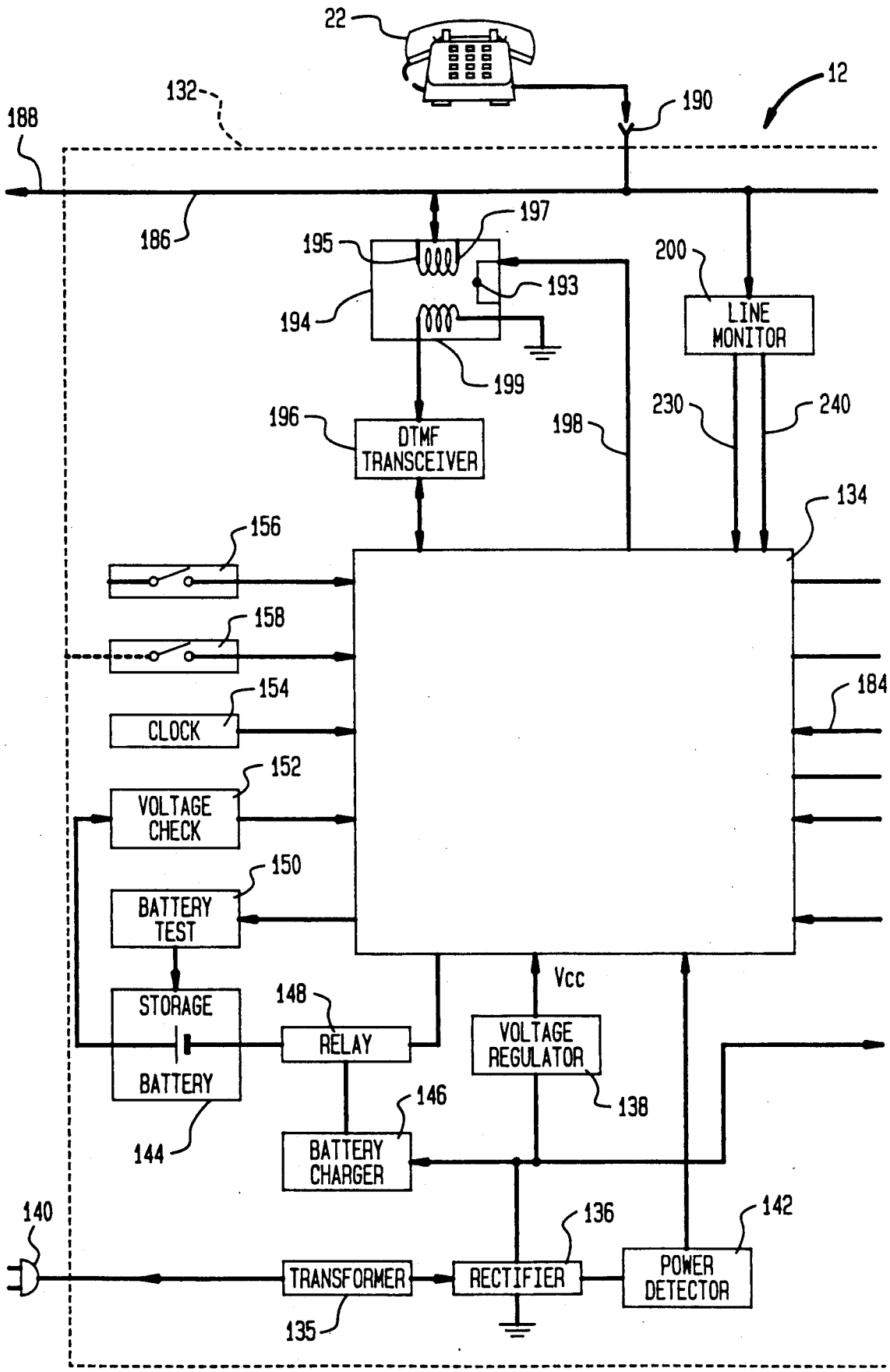

A personnel monitoring system in accordance with one embodiment of the present invention includes a tag 10 worn by each person to be monitored. The system further includes a monitoring unit 12 placed at each location where presence or absence of a person is to be monitored. Although one tag 10 and one receiving unit 12 are depicted in the drawings, the system typically includes a large number of these units, so as to permit monitoring of many persons at many separate monitoring locations within a community. Each monitoring unit is arranged to cooperate with only one particular tag. The system also includes a central computer installation 16 at a central location such as a security, police or parole office, where data concerning the presence or absence of monitored persons is to be collected. The central computer installation can be linked to the monitoring unit 12 at each location via the community telephone exchange 18 and telephone lines 20 serving the various remote monitoring locations. Ordinarily, a standard telephone instrument 22 is also connected to the telephone line at each monitoring location. Central computer installation 16 is also connected via community telephone exchange 18 and telephone lines 20 to the base station 24 of a commercial, common carrier radio beeper communications service. The beeper communications service provides for radio transmission of digital information to portable receivers 26 at any location within the community.

In the general scheme of operation of the system, tag 10 transmits radio frequency signals having a limited range. So long as the monitored person is at the monitoring location, the signals will be received by monitoring unit 12. If the monitored person leaves the monitoring location, he will take the tag with him and hence will take the tag out of radio transmission range. Thus, monitoring unit 12 will no longer receive the appropriately encoded signals from tag 10. The monitoring unit 12 will send an appropriate alarm signal to central computer system 16. Other alarm signals may be provided in case of attempts to tamper with the tag or monitoring unit, or in the event of a system malfunction. Upon receipt of an alarm signal from a particular monitored location, central computer installation 16 records and displays the same at the central location. The central computer also sends an indication via the beeper system transmitter 24 to a beeper system receiver 26 carried by a supervising person such as a parole officer in the field, remote from the monitoring location so that the officer may respond. The structure and function of the individual components of the system is described in greater detail hereinbelow.

THE TAG

Tag 10 includes an object 30 and an elongated strap 32 for securing the object to the body of the monitored person. The object 30 is in the form of a small hollow casing composed of a box-like element 34 with a bottom cover plate 36 secured thereto by appropriate fasteners (not shown) or by welding or gluing at the installation of internal components. A digital miniature encoding and radio frequency transmitter unit 40, is mounted within object 30, along with the associated antenna 42 and a battery 44. Encoding and transmitting unit 40 may be an encoding transmitter of the type commercially available in the security and electronics industries. Unit 40 preferably is arranged to send radio frequency transmission bursts repeatedly at predetermined intervals which may be on the order of every thirty or thirty-five seconds. Unit 40 is arranged to impress nine bits of digital information in a predetermined sequence on each such burst, and to repeat these bits several times within each burst. A register 46, which may be in the form of a set of code setting switches or a read-only memory, is provided as a part of unit 40. The encoding and transmitting unit 40 is arranged to set the values of some predetermined bits in the sequence according to the values stored in register 46. Thus, these bits remain constant on all bursts, and serve to identify the particular transmitting unit. Unit 40 is arranged to set the values of the other bits in the sequence according to digital high or low values received on input connections 50 and 52 respectively.

A conventional bistable device or "flip-flop" and a pulse shaping network 56 are also mounted within object 30. Flip flop 54 has an output connected to input 50 of the transmitter 40. The flip flop is adapted to provide either a high or a low digital output through input 50 and to change this output from high to low and vice versa upon receipt of an input pulse on a control input 57. Unit 40 has a timing pulse output 58, and is arranged to deliver a timing pulse on output 58 after each burst but before the next succeeding burst. Timing pulse output 58 is connected through pulse shaping network 56 to the control input 5 of flip flop 54. Thus, after each burst but before the next burst, flip flop 54 will receive a control input pulse from timing output 58 via pulse shaping network 56. Thus, the digital value supplied to input 50 will change from high to low or vice versa. The value of the particular bit in the transmitted signal set according to the value on input 50 thus will change on each burst.

Figure 7:
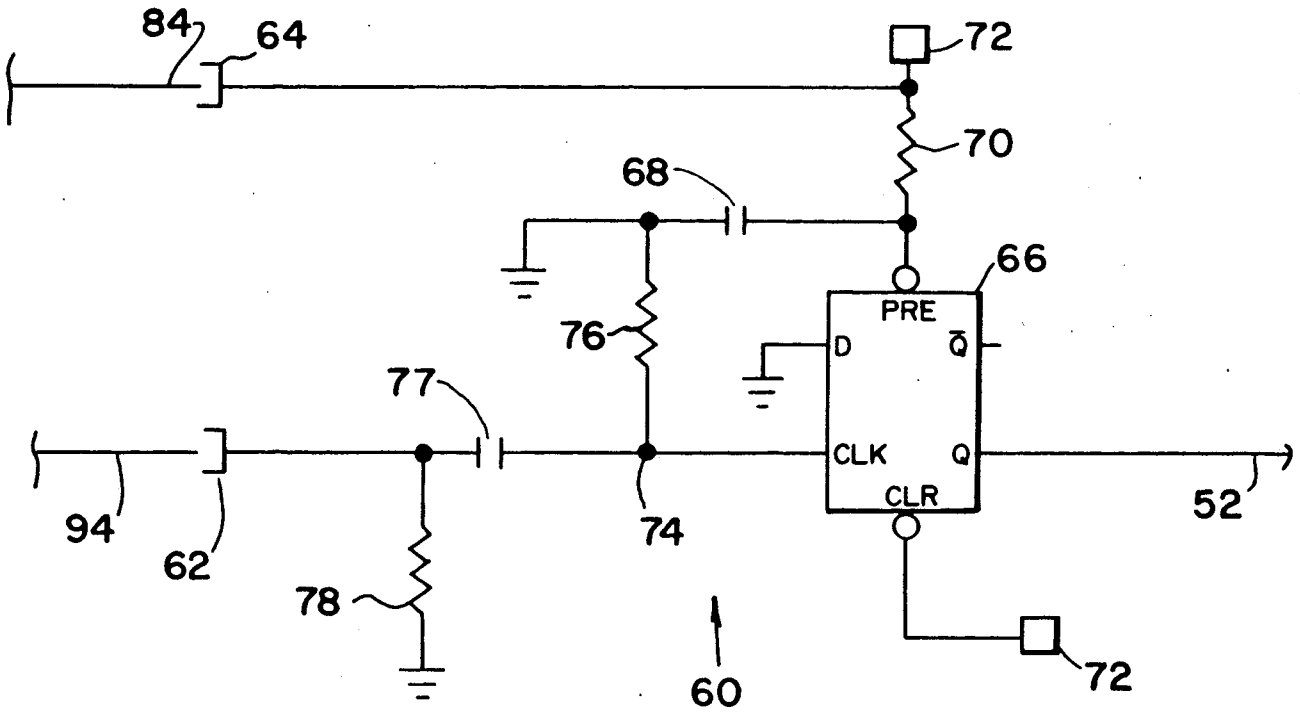
FIG. 7 is a schematic diagram showing a portion of the electrical circuitry in the tag of FIGS. 4–6.

A severance detection circuit 60 is also mounted within object 30. The severance detection circuit has an output connected to input 52 of encoder and transmitter 40, so that the value of the bit set according to input 52 in the transmitted signal depends upon the signal sent by severance detection circuit 60. The severance detection circuit has a pair of terminals 62 and 64. These terminals preferably are small metallic bushings having mechanical fastening fixtures such as bayonet fittings, snap fittings, screw threads or the like. These bushings are mounted to housing 30 in alignment with holes formed in the bottom plate 36 of the object so that an end face of each bushing is exposed on the bottom of the object (FIG. 4). Severance detection circuit 60 includes a D-type flip flop 66 (FIG. 7) having a preset input connected through a high impedance resistor 72 to a source of positive supply voltage, which source may be the positive terminal of battery 44. A capacitor 68 is connected between the preset input and ground. The clear input of the flip flop 66 is directly connected to positive voltage source 72. The D input of the flip flop is connected to ground. The Q output of flip flop 66 is connected to input 52 of encoding and transmitting unit 40, whereas the not-Q output is not connected. The clock or CLK input of flip flop 66 is connected to a circuit node 74, which in turn is connected to ground via a relatively low value resistor 76. Node 74 is also connected to one side of a capacitor 77. The other side of capacitor 77 is connected to ground via a relatively high value resistor 78 and to terminal 62. Terminal 64 is connected directly to the voltage source 72. When power is first applied to the system, i.e., when battery 44 is first installed, there is a significant delay in charging capacitator 68. During this delay, the voltage at the preset input is less than the voltage at the clear input, so that the Q output of flip flop 66 is set to low or 0. After this start-up period, the full position or logical 1 voltage is applied at both the preset and clear inputs. The Q output remains low until a positive-going voltage pulse of sufficient magnitude appears at the clock input, i.e., at node 74, whereupon the Q output will go high and will remain high regardless of any further signals supplied to the clock input. A positive-going voltage pulse must be greater than a predetermined threshhold voltage, set by the internal characteristics of flip-flop 66 in order to change the output of the flip-flop. The voltage pulse need not be prolonged. Any pulse duration more than a few nanoseconds will be sufficient. The voltage appearing at node 74 will be directly related to the current flow, if any, into capacitor 77. When terminal 62 is not connected, node 74 remains at ground potential. Any charge on capacitor 77 tends to dissipate rapidly through resistor 76. Where terminal 62 is connected to a source of positive voltage such as terminal 64 through a low impedance connection such as a direct short circuit, there is a momentary high inrush current into capacitor 77 and a momentary high current through resistor 76 to ground. This momentarily raises the potential of node 74 above the threshhold of flip-flop 66. Thus, even a momentary dead short between terminal 64 and 62 will trip flip-flop 66 and change the Q output of the flip-flop from 0 to 1. Once capacitator 77 is fully changed, the current flow stops but the Q output will remain permanently set or latched at 1. By contrast, a high impedance connection between terminals 64 and 62 will not produce a sufficient voltage at node 74 to trip the flip-flop and hence will not change the Q output of the flip-flop even if such high impedance connection persists indefinitely.

Strap 32 (FIGS. 4–6) includes a flexible printed circuit assembly formed by the techniques commonly employed to make flexible printed circuit boards in the electronics industry. This structure 80 includes an elongated, rectangular sheet like insulating film 82 approximately 0.025 mm thick formed from a polyimide polymer such as that sold under the commercial designation Kapton. Two metallic conductors extend on sheetlike insulator 82. A first conductor 84 includes a primary strip 84*a* on a first face 86 of insulator 82 and also includes two secondary strips 84*b* and 84*c* on the second, opposite face 88 of insulator 82. Strips 84*a*, 84*b* and 84*c* are connected to one another by a through connection 90 at a first end 92 of strap 32. The other conductor 94 includes a primary strip 94*a* on the second face 88 of insulator 82 and two secondary strips 94*b* and 94*c* on the first face 86 of insulator 82. Strips 94*a*, 94*b* and 94*c* are connected to one another by a through connection 96 extending through insulator 82 at the first end 92 of the strap. The primary strips 84*a* and 94*a* of these two connectors directly overlie one another on opposite sides of insulator 82. Likewise, each secondary strip of connector 84 directly overlies one secondary strip of the other conductor. Also, the secondary strips 84*b* and 84*c* of the first conductor lie alongside of strip 94*a* of the second conductor on the second side 88 of insulator 82, whereas the secondary strips 94*b* and 94*c* of the second conductor lie alongside the primary strip 84*a* of the first conductor on the first side 86 of the insulator. The strips are metallic copper deposited by the printing and plating processes normally used to deposit conductive strips on printed circuit boards. Preferably, each strip is about 0.025 inches wide and is of the thickness normally referred to in the printed circuit trade as "two ounce" thickness, viz., about two ounces of copper per square foot of strip area. Gaps about 0.012 inches wide are provided between strips on the same side of the insulator, so that strips of the first conductor are normally out of contact with the strips of the second conductor. All of the strips extend generally lengthwise along the elongated strap 32.

The flexible printed circuit assembly further includes cover sheet 98 overlying the strips and insulator 82 on the first side 86 of the insulator, and a similar cover layer 100 overlying the strips and insulator on the second side 88. The cover layers may be Kapton TM polymer and may be about 0.050 mm thick. These cover layers may be secured to insulator 82 and to the strips by an acrylic polymer adhesive (not shown) which may extend into the gaps 102 between strips.

The flexible printed circuit assembly also includes a first copper-covered connection area or pad 104 and a second copper covered area or pad 106 both disposed on the first side 86 of insulator 82 a short distance away from the first end 92 of the strip. Holes 108 and 110 extend through insulator 82 and through pads 104 and 106 respectively. The copper layer at first pad 104 extends through to the second side of insulator 82 and joins secondary strip 84*b* of the first conductor. Thus, first pad 104 is electrically connected to all of the strips 84*a*, 84*b* and 84*c* of the first conductor. The copper covered second pad 106 merges with secondary strip 94*c* of the second conductor so that the second pad 106 is electrically connected to all strips 94*a*, 94*b* and 94*c* of the second conductor.

An outer layer 112 formed from a soft, resilient, nonallergenic polymer suitable for contact with the skin surrounds the entire printed circuit assembly 80 throughout the length of the strap 32, so that the printed circuit assembly is effectively encapsulated in outer layer 112. The outer layer may be formed from a polymer such as the thermoplastic elastomer sold under the registered trademark Hytrel TM Grade 4059-FG by the DuPont Company of Wilmington, Delaware. A set of fastening holes 114 extends through the cover layer and through the printed circuit board assembly adjacent the first end 92 of strap 32, whereas further fastening holes 116 are provided at regularly spaced intervals along the length of the strap adjacent the second, opposite end 118 of the strap. Holes 114 and 116 penetrate the printed circuit board assembly remote from conductive strips 84 and 94. Further holes extend through the outer cover 112 and through the top and bottom cover layers 98 and 100 in alignment with pads 104 and 106, so that the pads are exposed on the top side of the strap (the sides facing upwardly in FIG. 4) and so that holes 108 and 110 are accessible from both sides. Preferably, strap 32 when manufactured is longer than required to encircle the wrist or ankle of a typical person to be monitored.

Fasteners 120 are provided. These fasteners are adapted to pass through holes 108 and 110 and to mate with terminals 62 and 64, thereby to hold pads 104 and 106 in engagement with terminals 64 and 62, respectively and in electrical contact therewith. Further, a conventional clinch type fastener schematically depicted at 122 is provided for securing the strap to itself to form a closed loop. Fastener 122 preferably is of a type available in the security industry and utilized for fastening identification bracelets to institutional inmates. The fastener has projections 124 arranged to pass through holes 116 and through holes 114, and the fastener is further adapted to be clinched or swaged to secure the fastener in place permanently.

Figure 3:
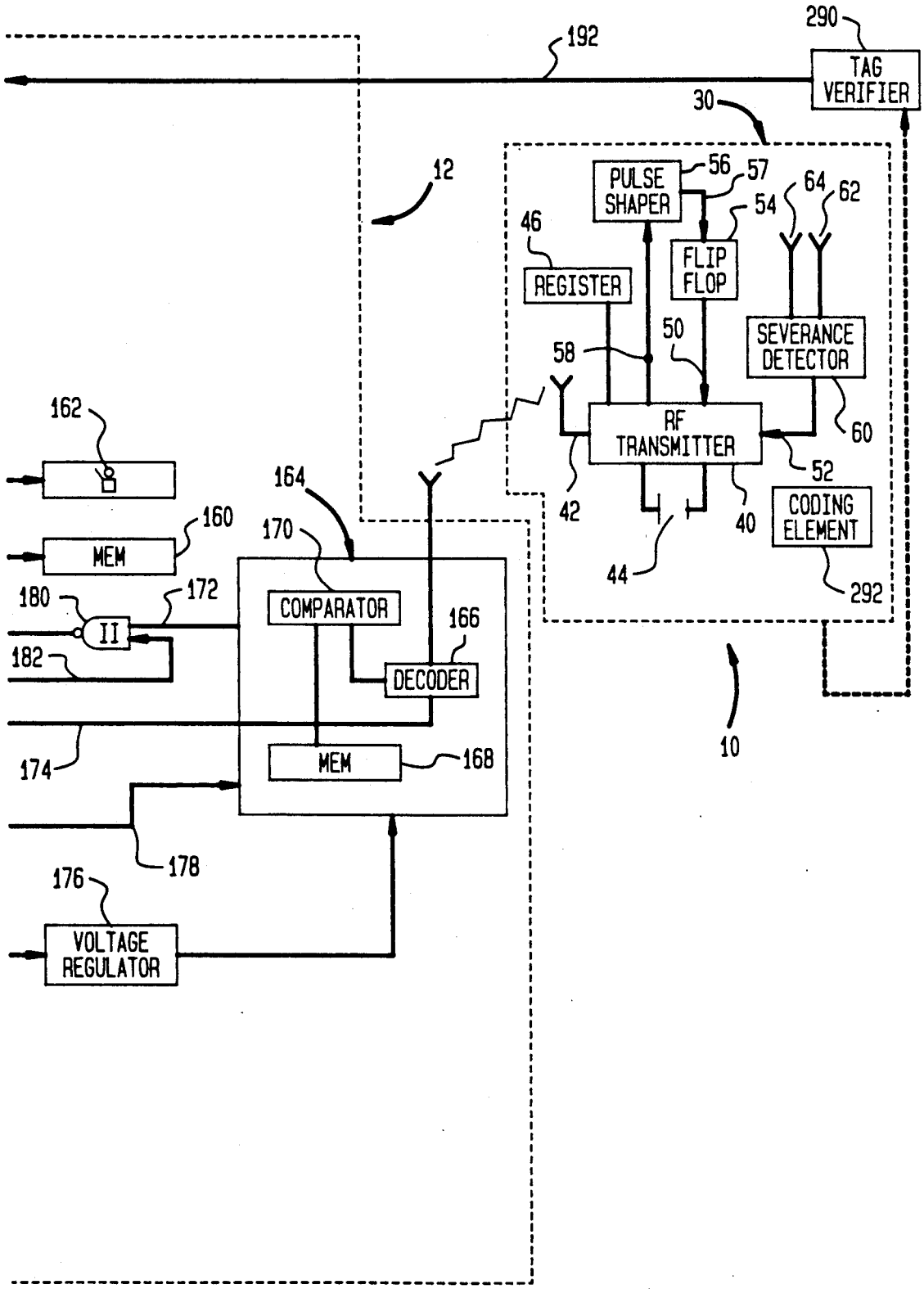

In use, the encoding and transmitting unit 40 is first energized by securing the battery 44 (FIG. 3) in place within object 30 and then closing bottom plate 36 and securing the same in place. At this point, flip-flop 66 of severance detection circuit 60 is set to provide a normal or 0 value on input 52 of encoding and transmitting unit 40. Unit 40 begins its normal cycle, emitting successive bursts constituting a normal radio signal. The tamper bit set by severance detection circuit 60 has a 0 value on each burst. On successive bursts, the value of the change bit set by flip-flop 54 changes back and forth from 0 to 1. On each burst, the values of the identifying bits set by register 46 will remain constant. The strap 32 is cut to the desired length by any ordinary cutting tool, such as a scissors leaving a new cut second end 118'. After the strap has been cut, it is connected to object 30 using fasteners 120 and also using other mechanical securement fasteners (not shown) to assure that the strap is securely engaged with object 30. Thus, conductors 84 and 94 are electrically connected to terminals 64 and 62, respectively. After the strap has been connected to the object, the object is placed on the body of a person to be monitored, as on the wrist or the ankle. Ends 92 and 188' are overlapped to form a loop snugly fit on the wrist or ankle of the monitored person, and the ends are fastened to one another. The encoding and transmitting unit is now in its normal condition, mounted on the person to be monitored. In this condition, the encoding and transmitting unit will continue to transmit the normal signal. There is no need to reset any portion of the encoding and transmitting unit after mounting.

Once fastened to the body by strap 32, object 30 cannot be removed from the body except by cutting the strap. Fasteners 120 are inaccessible while the object is mounted on the body, inasmuch as the fasteners lie beneath the object against the body of the person monitored. Preferably, a hypoallergenic cover 130 which may be a small piece of medical grade tape is secured over fasteners 120 after the fasteners are in place but before the strap is fit around the body of the person monitored. This provides further concealment of the fasteners 120 and avoids irritation of the skin.

Any attempt to remove the encoding and transmitting unit from the monitored person by severing strap 32 will cause a momentary electrical contact between the first and second conductors. An attempt to cut through the strap with an electrically conductive tool such as a normal knife blade, scissors or the like will provide electrical contact between the conductors. Surprisingly, however, an attempt to cut or sever the strap by using a non-conductive tool such as a glass or plastic blade, or by pulling or tearing the strap without tools, will also cause at least a momentary contact. For example, strip **84*a* may touch any of strips 94*a*, 94*b*, or 94*c*. Although the present invention is not limited by any theory of operation, it is believed that such momentary contact is facilitated by the close proximity of the strips constituting the first conductor with the strips constituting the second conductors. It is further believed that the flexibility of the surrounding polymeric structures facilitates contact between the conductors. Because the strips 84*a*–84*c* of the first conductor 84 are electrically connected to terminal 64 via pad 104, and the strips 94*a*–94*c* of the second conductor 94 are electrically connected to terminal 62 via second pad 106, any contact between the strips of the first and second conductors provides a direct, low-impedance short circuit between terminals 64 and 62. The resulting momentary voltage surge at node 74 triggers flip-flop 66 to change state, and causes value fed to transmitter 40 via input 52 to go from 0 to 1. After such momentary contact, flip-flop 66 remains in its changed state, and hence input to encoder and transmitter 40 remains at 1. Thus, upon any attempt to remove the object 30 from the monitored person by severing the strap 32, the encoding and transmitting unit will stop sending the normal signal described above, and will begin sending a different, tamper-indicating signal. This tamper-indicating signal is the same as the normal signal, except that it has a different value for the bit set by input 52**.

As will be appreciated, the cutting step used to trim strap 32 to the desired length during installation will momentarily bring conductors 84 and 94 into contact with one another. However, this action does not cause triggering of flip-flop 66 inasmuch as the strap is not connected to the severance detection circuit at the time of this preliminary cutting step. Whatever contact may occur does not persist. Here again, the present invention is not limited by any theory of operation. However, it is believed that the resilience of the polymeric structures surrounding the conductive strips brings the strips out of contact after they have been forced together during the preliminary cutting step.

The conductors 84 and 94 are exposed at the cut second end 118' of the strap. Although a spurious short circuit could conceivably occur if these exposed ends were to accidentally contact a common electrical conductor, this does not normally pose a problem in practice. As mentioned above, the severance detection circuit is substantially insensitive to high impedance connection between terminals 64 and 62 and hence insensitive to a high impedance connection between conductors 84 and 94. Accidental connections between these exposed ends and a common solid conductor, as those formed when cut end 118, brushes against the solid conductor, normally have impedance too high to trigger the severance detection circuit. Activities such as bathing (even in salt water) or immersion in household cleaning solutions generally do not cause spurious triggering of the severance detection circuit. It is believed that these favorable results are related to the relatively small cross sectional area of the conductor strips which limits the area available for contact at the cut end 118'. If desired, the cut end can be dipped into a common, commercially available curable electrically insulating material of the type commonly referred to as a "potting" compound and cured as required to provide a solid insulating coating at the cut end. Some suitable potting compounds for this purpose include epoxies and vinyl plastisols.

THE MONITORING UNIT

Monitoring unit 12 includes a housing 132. A microcomputer 134 is mounted within housing 132. Microcomputer 134 may be of the type sold under the commercial designation Motorola MC1468705G2. A conventional power supply including transformer 135, rectifier 136 and voltage regulator 138 is provided within the housing, and is connected to a conventional supply plug 140 for drawing AC power from a household utility outlet. The power supply further includes a conventional AC failure detection circuit 142 and storage battery 144. Further, the power supply apparatus includes a battery charger 146 connected to the rectifier circuit 136, a battery disconnect relay 148 and battery test load and voltage check circuits 150 and 152 respectively. Further, a conventional crystal oscillator clock 154 is also connected to the microcomputer 134. A program mode switch 156, connected to microcomputer 134, is mounted to housing 132. A housing security switch 158 is also mounted within the housing. Security switch 158 is connected to the microcomputer, and is mechanically linked to housing 132 so that the switch will be actuated if the housing is opened.

A conventional memory 160 is provided as a part of microcomputer 134. An audible signaling device, such as a buzzer 162 is connected for control by the microcomputer. Additionally, a radio frequency signal receiving and decoding unit 164 incorporates a decoding unit 166 for recovering the values of digital data bits encoded on an incoming radio frequency signal. Receiving and decoding unit 164 also includes a store or memory 168 for a first set of constant identification of bit values. The storage 168 may be provided in the form of permanent, unchangeable connections or in any other conventional form. Further, Unit 164 includes a comparison device 170. The Unit 164 is arranged to treat predetermined ones of the bits in an incoming signal is identifying bits, and to pass the recovered values for these predetermined identifying bits to comparison unit 170. Comparison unit 170 is arranged to compare these bit values with the corresponding values permanently stored in storage unit 168 and to provide a signal received indication on an output line 172 only if all of these identifying bit values match. Unit 164 is arranged to treat bit values other than the identifying bits as data bits and to pass the values of these data bits to microcomputer 134 along data output line 174. Unit 164 has characteristics matching those of RF transmission unit 40 discussed above. Thus, receiving and decoding unit 164 is arranged to accept incoming signals of the frequency used for transmission by encoding and transmitting unit 40. Further, the bit assignments used by receiving and decoding unit 164 are the same as those used by encoding and transmitting unit 40. Thus, where the encoding and transmitting unit utilizes constant identifying bit values for the first four bits of a nine-bit message, the receiving and decoding unit 164 is arranged to treat the first four bits as identifying bits and send those bit values to comparison unit 170. For the receiving and transmitting units to work with one another, the bit values for the identifying bits stored in store 168 of the receiving and decoding unit 164 must be the same as those stored in transmitter unit storage register 46 of transmitting and encoding unit 40. Typically, units 40 and 164 are sold commercially as sets. Each such set incorporates a unit 40 and a unit 164 having the same preset identifying bit values.

Receiving and decoding unit 164 is arranged to draw power from the rectifier 136 of the main power supply, via a voltage regulator 176. Further, unit 164 is provided with on/off control from microcomputer 134 via a control connection 178. The signal-received output 172 of unit 164 is connected to one input of a "not-and" or "NAND" gate 180. The other input of NAND gate 180 is supplied by microcomputer 134 via a connection 182. The output of NAND gate 180 is connected to the interrupt request input 184 of microcomputer 134.

A telephone line bus 186 is provided within the housing 132 of the monitor unit 12. This bus is provided with a conventional plug 188 for connection to an ordinary household telephone line, and with jacks 190 and 192 for connection of additional equipment to the bus. A telephone line interface 194 is provided. The telephone line interface desirably includes an isolation transformer having a line-side winding 195 connected in series with a switchable device such as a photoconductor 197. The circuit through the line-side winding 195 is thus normally open. A light-emitting device such as diode 193 is mounted in proximity to photoconductor 197 and coupled to microcomputer 134 via control line 198. The isolation transformer of interface 194 also includes an apparatus-side winding 199. A conventional dual tone multi-frequency or "DTMF" transceiver 196 is connected between the apparatus side winding 199 of the telephone line interface and microcomputer 134. When the light-emitting device 193, and hence switchable photoconductor 197, are actuated by the microcomputer, the circuit through the line-side winding 195 of the isolation transformer is closed, thus permitting transfer of audio frequency signals between telephone line bus 186 and DTMF transceiver 196. The DTMF transceiver is provided with conventional level control and driver circuits, all operating under the control of microcomputer 134, for receiving and sending digital information encoded as dual tone multi-frequency signals.

THE TELEPHONE LINE CONDITION MONITOR

Figure 8:
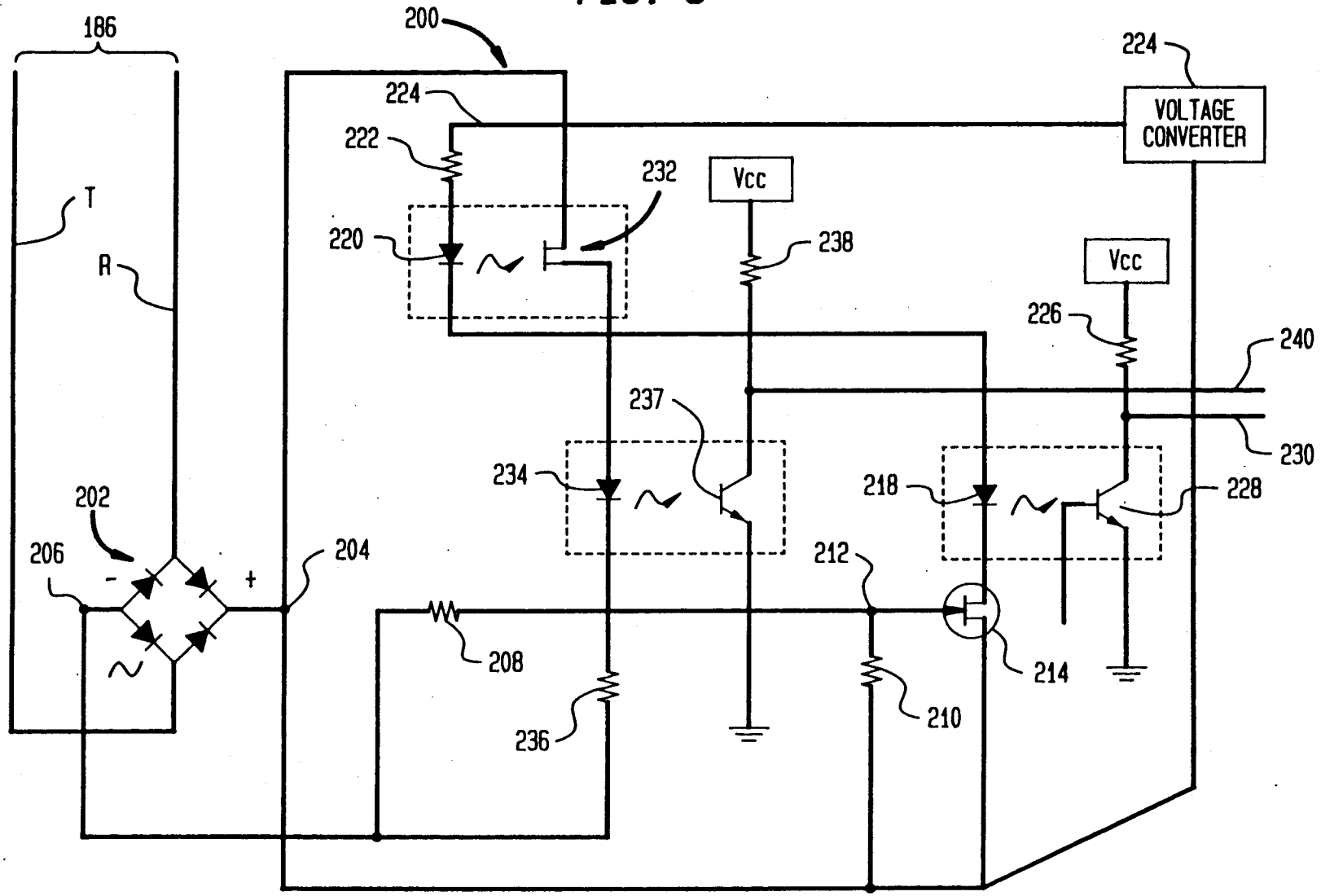
FIG. 8 is a schematic diagram showing a portion of the electrical circuitry of the monitoring system of FIGS. 1–3.

Monitor unit 12 also includes a telephone line condition monitor 200 mounted in housing 132. As shown in FIG. 8, line condition monitor 200 includes a rectifying bridge 202 connected across the tip and ring conductors T and R of bus 186. Rectifying bridge 202 has a positive output 204 and a negative output 206. Any voltage of whatever polarity appearing across the tip and ring conductors will appear as a positive voltage on output 204 with respect to output 206. Resistors 208 and 210, having resistances of about 6.2 megaohms and 620 kiloohms, respectively, are connected in series across bridge outputs 204 and 206 and, hence, effectively connected across the tip and ring conductors of bus 186. The node 212 between the series connected resistors is connected to the gate of a field effect transistor 214. The drain and source of field effect transistor 214 are connected in series with a first light-emitting diode 218, a second light-emitting diode 220 and a control resistor 222. A conventional DC to DC isolating voltage converter 224 is provided. Converter 224 incorporates an isolation transformer having a primary winding connected to the voltage regulator 138 of the main power supply means for repetitively switching current from the main power supply to provide a pulsating current in the primary winding of the isolation transformer a secondary winding and a rectifying diode and capacitor connected on the secondary winding. Series connected components 214, 218, 220 and 222 are connected across the secondary winding of converter 224 so that converter 224 will maintain a DC potential across series connected components, but will isolate these components, and hence telephone line bus 186 from the main power supply. A resistor 226 and the collector and emitter of a photoconductor 228 are connected in series between a source of main power supply positive voltage $V_{cc}$ and ground. Photoconductor 228 is juxtaposed with the first light-emitting diode 218. A first line condition output 230 is connected between resistor 226 and photoconductor 228. A further photoconductor 232 is juxtaposed with second light emitting diode 220. Photoconductor 232 is connected in series with a third light-emitting diode 234 and with a relatively low-impedance resistor 236 of about one kiloohm. Series-connected components 232, 234 and 236 are connected across the outputs 204 and 206 of rectifying bridge 202 and, hence, effectively connected across the tip and ring conductors of the telephone bus 186. A third photoconductor element 237 is connected in series with a resistor 238 between the main power supply voltage $V_{cc}$ and ground, and a second line condition output 240 is connected between these components. Preferably, each photoconductor 228, 237 and 232 is provided with the associated light-emitting diode as a standard, commercially available optical isolator unit.

Resistors 208 and 212 and FET 214 effectively constitute a first test means for detecting the voltage on telephone line bus 186. Where the voltage on bus 186 exceeds a predetermined threshold set by the values of the resistors and the characteristics of FET 214, the voltage appearing at node 212 will exceed the cutoff threshold of FET 214. In this condition, the FET will remain in a nonconducting or effectively open circuit state. Where the voltage on bus 186 is less than this predetermined threshold, FET 214 will become conductive between its drain and source. The threshhold voltage is typically about 10 volts. If bus 186 is connected to a telephone condition, with no handset connected, the voltage on the bus will be above the threshold. Thus, nonconductivity of FET 214 constitutes an on-hook signal, whereas, conductivity of FET 214 constitutes a not-on-hook signal.

In the on-hook state, with FET 214 nonconductive, light-emitting diode 218 will be open circuited and nonilluminated. First photoconductor 228 will be nonconductive, and the voltage appearing at output 230 will be equal to the voltage from source Vcc, i.e., a digital "1" Conversely, with FET conductive, the voltage at output 230 will be low or digital "0". Thus, the on-hook and not-on-hook signals are indicated on line 230 as digital 1 and 0 values, respectively.

In the on-hook condition, second light-emitting diode 220 will be nonilluminated and, hence, photoconductive element 232 will be nonconductive. In this condition, third light-emitting diode 234 and resistor 236 are effectively disconnected from telephone line 186. In the not-on-hook condition, with the voltage appearing on bus 186 below the aforementioned threshold, FET 214 is conductive, and light-emitting diode 220 is illuminated. Second photoconductor 232 is conductive, thus effectively connecting third LED 234 and low impedance resistor 236 across the telephone line. Resistor 236, light-emitting diode 234 and photoconductor 236 effectively provide a second means for testing the condition on the bus. The diode 234 and resistor 236 provide a relatively low impedance across the bus. The light output versus current characteristics of diode 234, and the conductivity versus light input characteristics of photoconductor 237 cooperatively establish a threshold current value. If the current flow through diode 234 and resistor 236 is less than this predetermined threshold current, telephone line bus 186 is disconnected from the telephone system, photoconductor 237 will be nonconductive. In this disconnect condition, the voltage on second output line 240 will be the source voltage $V_{cc}$ or the digital high or 1. If the telephone line bus 186 is connected to the telephone system, but the line is in an off-hook condition, with a telephone handset connected across it, there is a relatively low voltage on the line, typically about 5 volts. Nonetheless, this voltage is sufficient to produce a current equaling or exceeding the predetermined threshold so that photoconductor 237 is conductive, and the output voltage is low or digital 0. Thus, $V_{240}$ when low or zero indicates an off-hook condition. $V_{240}$ high, in conjunction with a not on-hook signal or digital zero condition on output 230 indicates that the phone line is disconnected from the system. The "truth table" for this system is as follows:

TABLE

| Condition of Bus 186 | $V_{230}$ | $v_{240}$ |
|---|---|---|
| On Hook (High Voltage) | 1 | 1 |
| Off Hook (Lower Voltage) | 0 | 0 |
| Disconnected | 0 | 1 |

THE CENTRAL COMPUTER INSTALLATION

Computer installation 16, located at a central monitoring office, includes a conventional digital computer of the type commonly referred to as a "personal computer" A display 252 is linked to computer 250, as is printer 254 and memory unit 256 such as a tape or disk drive. Computer 250 is connected to a telephone line 20 through a conventional modulator/demoldulator or modem 258 arranged to perform conventional telecommunication functions. Thus, modem 258 is capable of placing a telephone call to a telephone number designated by computer 250 and to answer incoming telephone calls responsive to a ring signal on line 20 and link the computer to the line. Further, the modem is arranged to translate between digital data going to or from the computer and audio frequency signals on line 20.

OVERALL SYSTEM OPERATION

Before the monitoring unit 12 is placed at a monitoring location such as at the home of a parolee, it is programmed with data setting parameters for the monitoring process. This data may include time tolerance data setting forth a delay or tolerance time which may elapse without receipt of signals from tag 10 before the person is considered absent. The delay time may be set to allow nonreceipt of signals for a few minutes so as to accommodate situations where the monitored persons normal activities while at home might take him briefly out of range, as to use sanitary facilities or the like. Also, the preprogrammed data includes data identifying the monitoring unit itself, the telephone number of the central computer installation and data setting forth a handshake protocol, i.e., data defining a predetermined exchange of signals back and forth between the monitoring unit and the central computer to establish that monitoring unit 12 is, in fact, connected to the central computer via the telephone network. Additionally, the preprogrammed data will include time intervals between routine calls to be placed by the monitoring unit to the central computer unit even while no alarm signal is to be transmitted. The program data is entered into memory by connecting bus 186 to central computer 250 via a local telephone line to modem 258 and actuating program switch 156. This actuation causes microcomputer 134 to connect to telephone line bus 186 via interface 196, check for a predetermined programming handshake signal and interpret signals received via telephone interface 196 after the programming handshake signal as program data. If no programming handshake is received within a brief predetermined interval, the unit returns to normal operation as described below. Thus, tampering with program switch 156 will not disable the monitoring unit. The program data is supplied on bus 186 by central computer 250 in DTMF form, in a predetermined sequence such that each item of data is stored by microcomputer 134 in an appropriate location in memory. After programming, the monitoring unit 12 is positioned at the home or other monitoring location. Telephone line bus 186 is connected via plug 188 to the telephone line 2 serving the monitoring location. A standard telephone instrument 22 is connected to bus 186, and hence to line 20, through receptacle 190.

As discussed above, tag 10 repeatedly transmits RF signal bursts incorporating identifying bits from register 46, a change bit set by flip-flop 54 which alternates between 1 and 0 on successive bursts, and a tag tamper bit set by severance detection circuit 60. The tamper bit is normally 0, but becomes 1 after an attempt to sever the tag from the monitored person. While the monitored person is within range of the RF signal, receiving and decoding unit 164 receives a continual stream of these bursts. Provided that the identifying bits match the identifying bits stored in register 170, receiving and decoding unit 164 sends a high or valid transmission signal on line 172 to NAND gate 180. The valid transmission signal will be sent regardless of the values for the change bit and the tag tamper bit. These two bits are sent separately on data line 174 to microcomputer 134. Microcomputer 134 normally maintains NAND gate 180 enabled by maintaining a continuous high or logical 1 signal on line 182. If a valid transmission signal is received while NAND gate 180 is enabled, the valid transmission signal from line 172 will pass through the NAND gate to input 184 of the microcomputer 134. This input is connected to the interrupt request input of the microcomputer.

Upon receipt of such a valid transmit signal, the microcomputer responds to the interrupt request by entering a predetermined subroutine. In this subroutine, the microcomputer checks the tag tamper bit received on the current transmission. If the tag tamper bit is a 1, i.e., if the tag 10 is sending a tamper signal, the microcomputer stores a tag tamper status in memory 160. The microcomputer also compares the change bit received with the current transmission against the change bit received on the last transmission. If the two are the same, the microcomputer increments a counter. If the count in this counter, after incrementing, exceeds a preset maximum, typically 5, the microcomputer sets a signal forgery status. Thus, if a series of bursts having the appropriate identifying bits, but all having the same value for the change bit is received by receiving and decoding unit 164, the count maintained by this counter will be incremented on each such burst. Thus, the signal forgery status will be set after the first few bursts. If the change bit received on the current burst or transmission is different from the change bit received on the last previous burst or transmission, the microcomputer resets the change bit counter and does not set the signal forgery status. Also, the microcomputer stores the change bit received on the current burst for use in the comparison when the next burst is received. The microcomputer resets an absence time counter to a starting value equal to the number of minutes set as an absence tolerance. Also, if the return-home counter discussed below is operating, and if the change bit received on the current burst differs from the change bit received on the last previous burst, the microcomputer will increment that counter. After performing these functions, the microcomputer returns from the subroutine.

Microcomputer 134 also executes a timing routine once each minute. During the timing routine, the microcomputer decrements the absence time counter. If the absence time counter reaches 2, the microcomputer actuates buzzer 162 so as to warn the monitored person that the monitoring unit 12 is not receiving signals from the tag 10. This warning is repeated when the absence time counter reaches 1. If the absence time counter reaches zero, this indicates that an interval equal to the time set as an absence tolerance has elapsed without execution of the interrupt request subroutine discussed above, i.e., without receipt of a valid radio frequency signal by unit 164. When this occurs, the microcomputer sets an absence alarm status. The microcomputer also turns on a return home counter and sets this counter to an initial, negative value, most preferably −3. On subsequent one minute cycles, the microcomputer checks the return home counter and sets a "returned home" status only if the returned home counter is at zero. The returned home counter will only be incremented on the interrupt request subroutine in response to a valid transmission having a change bit value different from the change bit value in the preceding transmission. Accordingly, the returned home counter will only reach zero if there are three successive valid transmissions with properly varying change bit values. Thus three good transmissions or bursts from tag 10 are required to produce a returned home status.

As the microcomputer is cycled through successive one-minute cycles, it performs "housekeeping" functions such as checking for presence or absence of AC power detection circuit 142 and, at periodic intervals, testing the condition of battery 144 using battery load circuit 150 and battery test circuit 152. A record of any abnormal status is stored in memory 160. Further, the microcomputer checks the status of receiver unit tamper switch 158, and stores a receive unit tamper status in memory 160 if the switch is actuated.

Microcomputer 134 periodically executes a supervisory cycle. During this cycle, the microcomputer disables NAND gate 180 by setting a low or zero signal on control line 182, so that the output of NAND gate 180 will always be a high or 1 signal regardless of the status of line 172. Thus, during the supervisory cycle, the microcomputer ignores receipt of signals by RF unit 164. During this supervisory cycle, microcomputer 134 repetitively checks appropriate locations in memory 160 to determine whether an abnormal status exists. Thus, the microcomputer checks for a signal forgery status, tag tamper status, absence alarm status, returned home status and any of the other abnormal status indications mentioned above. If no abnormal status exists, the microcomputer checks to see if the time for a routine reporting call has arrived. If there is an abnormal status, or if it is time for a routine call, the microcomputer enters a phone call placement routine.

As the first step of the call placement routine, the microcomputer examines the signals on lines 230 and 240 from line condition monitor 200 to determine whether the phone line is in use. The microcomputer interprets the signals on lines 230 and 240 as indicating on-hook, off-hook or disconnected status of the phone line according to the truth table for line condition monitor 200 discussed above. Additionally, the microcomputer monitors these signals on lines 230 and 240 for a sufficient period of time, typically about one minute, to determine whether or not these signals are changing. If these signals continually change between an on-hook indication (1 on line 230 and 1 on line 240) and a disconnect indication (0 on line 230 and 1 on line 240) the microcomputer interprets such a change as an incoming ring signal rather than as an on-hook or disconnect condition. If the microcomputer detects a continual disconnect condition, that status, is recorded in memory 160 as an abnormal status. If the microcomputer detects an incoming ring condition, it will not attempt to place a call, but instead, will wait for a preset delay period of seconds and start the supervisory cycle again. If the system detects an off-hook condition rather than an incoming ring, the microcomputer will send a signal on control line 198 to momentarily actuate phone line interface 194. The microcomputer will then send three brief audio frequency courtesy tones through DTMF transceiver 196. These brief tones will signal anyone talking on the line, as via telephone 22, that the system is attempting to place a call. After sending these tones, the microcomputer will disable telephone line interface 194, wait for the preset delay period and then repeat the supervisory cycle.

If an on-hook condition rather than a disconnect, off-hook or incoming ring condition has been detected, the system will place a call to central computer installation 16. Where the program data in memory 160 calls for pulse dial operation, microcomputer 134 will repeatedly enable and disable phone line interface 194 by sending successive high and low signals on control line 198, thus repeatedly connecting and disconnecting the primary winding 195 of phone line interface 194 across the telephone line bus 186, causing repeated on-hook and off-hook conditions on the telephone line. The pattern of such connections and disconnections with time is selected to correspond to the pattern of on-hook and off-hook conditions created by a conventional pulse dialing of the telephone number for the central computer. Where the program data in memory 160 calls for DTMF dialing, microcomputer 134 maintains phone line interface 194 continuously enabled, with primary winding 195 continuously connected across phone line bus 186, and sends the phone number of the central computer through DTMF transceiver 196, so that the same is transmitted as a series of DTMF tones onto the phone line.

After executing the dialing routine, whether by pulse dialing or by DTMF dialing, the microcomputer maintains the phone line interface enabled for a predetermined period of time. During this time, the microcomputer attempts to execute the handshake routine according to the stored data in memory 160. Assuming that the telephone line 20 to central computer installation 16 is not busy, and that the community telephone system 18 is functioning properly, the dialing operation will result in a call reaching modem 258 which will answer the call, send a predetermined tone signal and connect the central computer to the line. Upon receipt of this predetermined tone signal via DTMF transceiver 196, microcomputer 134 initiates the handshake routine by sending predetermined data from memory 160 as a series of DTMF tones, which, in turn, are translated to digital data by modem 258 and dispatched as digital data into computer 250. The central computer 250 sends back appropriate answering data, which is compared by microcomputer 134 to the expected answer data stored in memory 160. The exchange of data occurring during the handshake routine indicates to central computer 250 the identity of the particular remote monitoring unit 12 which is in communication with the central computer. Thus, an appropriate identifying number or the like stored in memory 160 may be sent to central computer 250 during the handshake. If the expected sequence of data transmitted and received, constituting the full handshake cycle is successfully executed, the microcomputer sends data stored in memory 160 indicating the existence of any abnormal status. The abnormal status may be an absence alarm status, a tag tamper, a receiver unit tamper, or systems difficulties such as loss of AC power, low battery or the like. Thus, different messages will be sent indicating whether the call is a routine call or whether an abnormal status exists, and if so, the nature of the abnormal status. These abnormal status signals serve as alarm signals indicating to the central computer that a problem exists at the remote monitoring location. The central computer 250 is programmed to recognize the different signals sent by microcomputer 134 to indicate abnormal conditions.

Memory 256 associated with central computer 250 may include data establishing a correlation between the identity of a particular remote monitoring unit 12 and the location and/or identity of the person monitored. The data stored in the central computer memory 256 may include the telephone number for the monitoring location where each remote receiver is installed, and typically, also will include the name of the monitored person. Upon receipt of an alarm signal indicating an abnormal condition, central computer 250 will display an appropriate message on display 252 indicating the identity and location of the monitored person and the nature of the abnormal condition. The central computer will also print out this information via printer 254 to make a permanent record of the condition, and may also store a record of this condition in memory 256. Thus, a monitoring officer at the central location will learn of any absence of a monitored person from a monitored location, any tampering with the tag or monitoring unit 12 or any other system difficulty. Computer 250 may be arranged to ignore absence alarm signals from particular remote monitoring units 12 during certain times of the day, as where the person monitored by that particular unit is permitted to be absent at some times.

The central computer may also be arranged to dispatch an alarm signal through modem 258, telephone line 20 and community telephone exchange 18 to a commercial, common carrier radio broadcast beeper system 24. Desirably, this alarm signal is accompanied by data indicating the telephone number associated with the location where the absence has occurred. This information desirably is also accompanied by data indicating the identity of the officer to be notified, such as a number designating a particular beeper receiver 26 worn or carried by the officer. Central beeper transmitting system 24 sends the alarm signal, including the identifying telephone number of the location where the absence has occurred to the beeper receiver 26 worn by the officer. The beeper receiver desirably displays this data in numerical form. The officer can then consult a table or list correlating the telephone numbers of various monitoring locations with the street address of the monitoring location. Thus, the officer can proceed immediately to the monitoring location. If desired, the central computer 250 may also be arranged to send additional data indicating the nature of the abnormal status.

Central computer 250 is arranged to echo back the status signal sent by microcomputer 134, and the microcomputer is arranged to check the returned or echoed data against the data sent. The microcomputer likewise reports the time of day according to its internal clock and receives an echo from the central computer 250. If both the status and time have been echoed correctly, the microcomputer clears the abnormal status from its memory and terminates the supervisory cycle.

If not, the microcomputer waits and then repeats the supervisory cycle.

As described more fully in U.S. Pat. Application No. 765,343, filed Aug. 13, 1985, now U.S. Pat. No. 4,747,120, the disclosures of which are incorporated by reference, a tag verifying unit 290 may optionally be provided at each remote monitoring location. When such a verifying unit is provided, the same is connected to the telephone line via receptacle 192 and bus 186.

Where the system includes optional verifying device 290, object 30 may have one- or more coding elements 292 mounted within casing 34. These coding elements may be arranged to interact with the verifying device 290 (FIG. 3) by means other than radio frequency transmission. As described in greater detail in said U.S. Pat. No. 4,747,120 the verifying device may be arranged to detect coding elements by magnetic, capacitive or conductive means. Desirably, the coding elements are concealed within the object 30 in a predetermined pattern. Thus, the object 30 can be used to interact either with monitoring unit 12 or with verifier 290.

The central computer 250 may be programmed to dial the telephone number of a remote monitoring location and send signals through the telephone lines to the standard telephone 22 instructing the parolee to insert tag 10 into verifying unit 290. The verifying unit reads encoded information on the tag and sends an appropriate verification signal back to the central computer indicating that the tag has been inserted. This confirms that the tag, and hence the monitored person is present at the monitored location. If the appropriate return signal is not received, then the central computer will treat such absence as an indication that the monitored person is not present.

Numerous variations and combinations of the feature discussed above can be utilized. For example, the strap severance detection circuit 60 may be arranged to alter the RF signal from transmitting unit 40 by terminating that signal entirely in response to a severance attempt rather than by altering a single bit value within the signal. In this case, the monitoring unit would send the same signal to the central computer for strap severance as for an absence of the monitored person. Conversely, the severance detection circuit may alter the emitted signal in the sense of starting a transmitter to send an RF signal in response to strap severance. The severance detection circuit can be used with signals other than RF signals. For example, some monitoring systems use a tag arranged to display a signal in the form of a code number which changes periodically. The monitored person enters the code number into a central computer via a telephone to verify his presence. In such a system, the severance detection circuit may be arranged to alter the code number display, as by disabling the display or changing the number shown.

Figure 9:
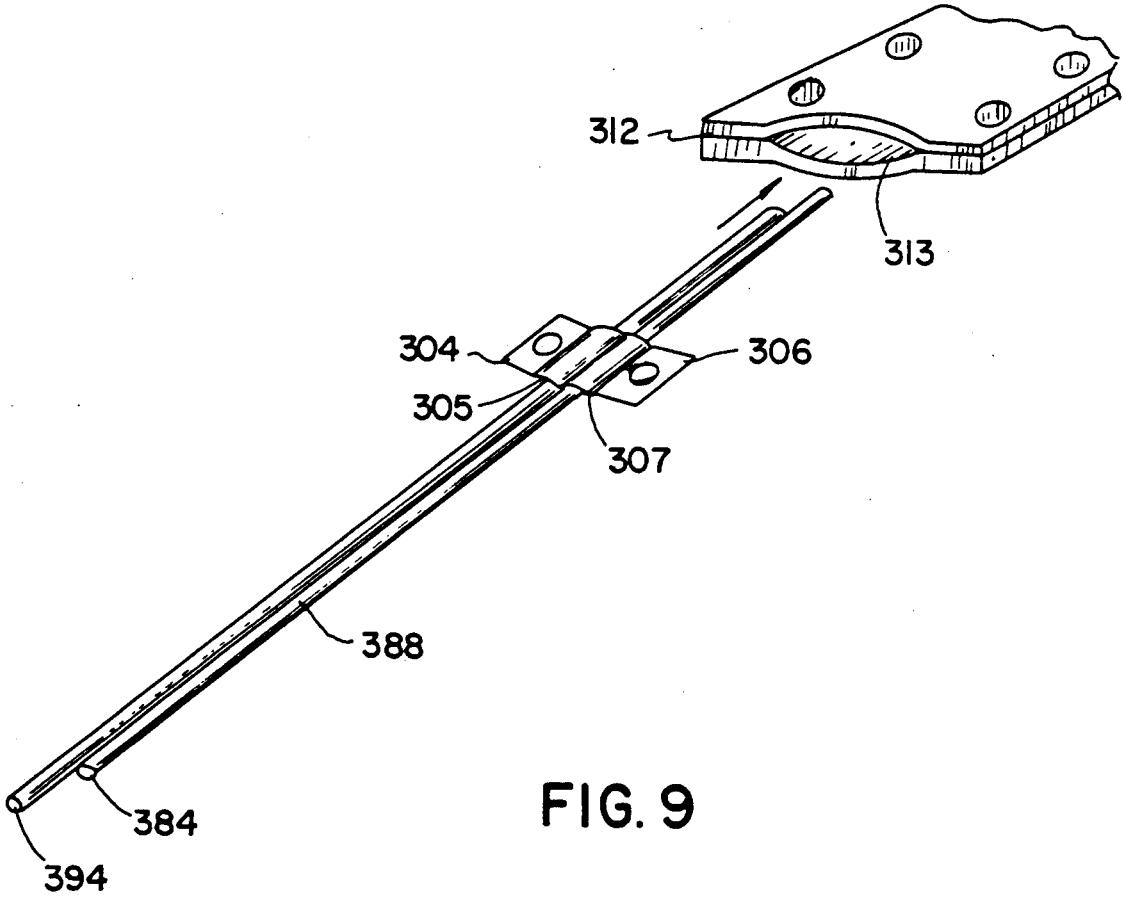
FIG. 9 is a fragmentary schematic view but depicting a tag in accordance with a further embodiment of the invention.

The configuration of the strap may differ from that discussed above. Thus, each conductor may include 1, 2, 3 or more individual strips or elements. Further, the elements of the conductors can be arranged in various patterns such as coaxially or as pairs of intertwined elements. A particularly simple and economical conductor arrangement is shown in FIG. 9. Two conductors 384 and 394 are provided as part of a two-conductor cable of the type commonly known in the trade as "ribbon cable". Each conductor may be a 28 gauge (American Wire Gauge) wire. The cable preferably includes a vinyl insulation jacket 388 surrounding the conductors, the insulation maintaining the conductors at 0.050 inch center-to-center spacing. Metallic terminals 304 and 306 are connected to wires 394 and 384, respectively. Terminals 304 and 306 have insulation sleeves 305 and 307, respectively, covering only the abutting portions of the terminals to prevent electrical contact therebetween. The cable assembly including the conductors and terminals can be used with a multilayer outer cover 312 having a pocket 313 extending lengthwise along the strap. The cable assembly is disposed within the pocket 313 so that wires 384 and 394 extend lengthwise along the strap, and so that terminals 304 and 306 are aligned with holes in outer cover 312. The entire strap, including the wires and outer cover is cut to the desired length. Preferably, the ends of the wires 384 and 394 are trimmed individually after the strap is cut to length, as by inserting a wire cutter into pocket 313, so as to provide lengthwise staggering at the cut ends. This diminishes the possibility of an accidental short circuit at the cut ends. A strap severance detection circuit as discussed above may be employed in systems other than a personnel monitoring tag. For example, the severance detection system can be used with an elongated security strap extending through items displayed for retail sale in a theft-detection system.

As numerous variations and combinations of the features described above can be used without departing from the present invention as defined by the claims, the foregoing description of the preferred embodiment should be taken by way of illustration rather than by way of limitation of the present invention.

We claim:

1. A personnel monitoring tab comprising:

(a) an object incorporating means for emitting a signal;

(b) fastening means for attaching said object to the body of a person to be monitored;

(c) indicative means having an tamper state and a non-tamper state, said indication means being switchable from said non-tamper state to said tamper state, indication means including means for altering said signal while in said tamper state;

(d) latch means for retaining said indication means in said tamper state after said indication means is switched into said tamper state; and (e) sensor means for detecting detachment of said object from the body of the person and switching said indication means from said non-tamper state to said tamper state when said object is detached from the body, said latch means being operative to retain said indication means in said non-tamper state before said indication means is switched to said tamper state by said sensor means, said sensor means being inoperative to switch said indication means to said tamper state before said object is first attached to the body by said fastening means, whereby said indication means will be in said non-tamper state when said object is first fastened to the body of the person to be monitored.

2. A personnel monitoring tag as claimed in claim 1 wherein said fastening means includes an elongated strap connected to said object and means for securing said strap about a part of the body, said sensor means including means for detecting severance of said strap.

3. A personnel monitoring tag as claimed in claim 2 wherein said means for detecting severance of said strap includes a first electrical conductor and a second electrical conductor, said first and second conductors extending generally lengthwise along said strap in proximity to one another, said first and second conductors normally being out of contact with one another, and means for detecting electrical contact between said first and second conductors.

4. A personnel monitoring tag as claimed in claim 1 wherein said indication means and said latch means include components disposed within said object, said indication means and said latch means being constructed and arranged so that said indication means cannot be reset from said taper state to said non-tamper state without opening said object and gaining physical access to said components.

5. A personnel monitoring tag as claimed in claim 4 wherein said object and said fastening means are constructed and arranged so that said object cannot be opened readily while said object is attached to the body of a person by said fastening means.

6. A personnel monitoring tag as claimed in claim 1 wherein said signal-emitting means includes means for providing a normal electromagnetic signal when said indication means is in said non-tamper state, said means for altering an electromagnetic signal including means for suppressing said normal signal.

7. A personnel monitoring tag as claimed in claim 6 wherein said indication means includes means for activating said signal-emitting means to emit a tamper electromagnetic signal different from said normal signal when said indication means is in said tamper state.

8. A security device comprising an elongated strap and means for detecting severance of said strap, said means for detecting severance including first and second electrical conductors extending generally lengthwise along said strap in proximity to one another, but normally out of contact with one another and means for detecting electrical contact between said first and second conductors, said means for detecting electrical contact between said conductors including means for maintaining said conductors at different potentials so that no current flows through said conductors while said conductors are out of contact with one another and means for detecting current flow in said conductors, whereby said current flow will indicate electrical contact between said conductors.

9. A security device as claimed in claim 8 further comprising an electrically insulating material disposed between said first and second conductors.

10. A security device as claimed in claim 9 wherein each of said first and second conductors is metallic.

11. A security device as claimed in claim 10 wherein said electrically insulating material is a polymeric material.

12. A security device as claimed in claim 9 wherein said insulating material includes a sheetlike insulator, wherein said first conductor includes a primary strip extending on a first side of said insulator, and said second conductor includes a primary strip extending on a second side of said insulator, so that said primary strips of said first and second conductors overlie one another on opposite sides of said sheetlike insulator.

13. A security device as claimed in claim 12 wherein said first conductor includes a secondary strip disposed on said second side of said insulator alongside said primary strip of said second conductor.

14. A security device as claimed in claim 13 wherein said second conductor has a secondary strip disposed on said first side of said insulator alongside said primary strip of said first conductor and overlying said secondary strip of said first conductor.

15. A security device as claimed in claim 13 wherein said insulator is less than about 0.005 mm thick.

16. A security device as claimed in claim 8 further comprising an object, means for fastening an object to said strap and means for fastening the strap to a body so that said strap secures said object to the body.

17. A security device as claimed in claim 8 wherein said means for detecting current flow in said conductors includes means for detecting momentary current flow and providing a signal indication of electrical contact only if said momentary current flow exceeds a predetermined magnitude.

18. A personnel monitoring system comprising:

(a) transmitter means for automatically sending a transmitted signal having a limited range and bearing a plurality of data bits each having a discrete value;

(b) fastening means for attaching said transmitter means to a person to be monitored;

(c) monitoring means for receiving a signal, recovering data bit values from the received signal, testing the recovered values to determine whether or not the received signal is a valid transmitted signal from said transmitter means, and issuing an indication that said person to be monitored is present in the vicinity of said monitoring means only if a valid signal is received, said plurality of data bits including at least one preselected change bit, said transmitter means including change means for varying the value of each said change bit in said transmitted signal according to a predetermined pattern of variation, said monitoring means including change test means for determining whether the value of each said change bit in the received signal varies according to said predetermined pattern and inhibiting the indication that the monitored person is present if said change bit value does not vary in accordance with said predetermined pattern.

19. A personnel monitoring system as claimed in claim 18 wherein said plurality of data bits includes a plurality of identifying bits, and wherein said transmitter means includes means for providing predetermined constant values for said identifying bits in said transmitted signal.

20. A personnel monitoring system as claimed in claim 19 further comprising forgery detection means for determining that said monitoring means has received signal wherein the values of said identifying bits correspond to the constant identifying bit values of a valid signal but wherein the value of said at least one preselected change bit does not vary with time according to said predetermined pattern of variation, and providing a counterfeit signal indication upon such determination.

21. A personnel monitoring system as claimed in claim 20 wherein said transmitter means includes means for sending said transmitted signal as a series of bursts, said change means includes means for causing the value of each said change bit in said transmitted signal to alternate between a first value and a second value on successive bursts of said transmitted signal.

22. A personnel monitoring system as claimed in claim 21 wherein said change means includes means for varying the value of only one of said bits.

* * * * *

UNITED STATES PATENT AND TRADEMARK OFFICE

CERTIFICATE OF CORRECTION

PATENT NO. : 5,032,823

DATED : July 16, 1991

INVENTOR(S) : Bower et al.

It is certified that error appears in the above-identified patent and that said Letters Patent is hereby corrected as shown below:

On the title page:
In the ABstract, line 12, "servering" should read --severing--.

Column 4, line 28, "attached" should read --attach--.
line 30, "of" should read --on--.
line, 41, "conductors," should read -- conductors.".
Column 8, line 12, "5" should read --57--.
line 53, "capacitator" should read --capacitor--.
Column 9, line 13, "capacitator" should read --capacitor--.
Column 12, line 25, "118," should read --118',--.
Column 15, line 22, "Vcc," should read --$V_{cc}$--.
line 22, "1" should read "1.".
line 61, "not on-hook" should read --not-on-hook--.
line 66, "$^{V}$240" should read --$^{V}$240".
Column 16, line 13, "puter" should read --puter".--.
Column 17, line 1, "2" should read --20--.
Column 21, line 65 - please note that the bolded number 28 should not be bold as it does not indicate reference numbers or figure numbers.
Column 22, line 37, "indicative" should read --indication--.
line 37, "an" should read --a--.
line 40, after "state," insert therefor --said--.

UNITED STATES PATENT AND TRADEMARK OFFICE

CERTIFICATE OF CORRECTION

PATENT NO. : 5,032,823

DATED : July 16, 1991

INVENTOR(S) : Bower et al.

It is certified that error appears in the above-identified patent and that said Letters Patent is hereby corrected as shown below:

Column 24, line 49, after "received" insert therefor --a--.

Signed and Sealed this

Eighth Day of December, 1992

*Attest:*

DOUGLAS B. COMER

*Attesting Officer*

*Acting Commissioner of Patents and Trademarks*